US006568511B1

(12) United States Patent
Day

(10) Patent No.: US 6,568,511 B1
(45) Date of Patent: May 27, 2003

(54) ADJUSTABLE LIFTING SLING

(76) Inventor: Steven T. Day, c/o TDS Erectors, Inc. P.O. Box 271, Ashdown, AR (US) 71822

( * ) Notice: Subject to any disclaimer, the term of this patent is extended or adjusted under 35 U.S.C. 154(b) by 0 days.

(21) Appl. No.: 09/416,809

(22) Filed: Oct. 13, 1999

(51) Int. Cl.[7] ..... B65H 59/14
(52) U.S. Cl. ..... 188/65.4; 188/65.3
(58) Field of Search ..... 188/64.1, 64.2, 188/64.3, 64.4, 64.5; 187/356, 361, 362, 363, 366, 367, 370, 368, 369, 375, 378, 379; 254/391; 294/75, 76; 934/33

(56) References Cited

U.S. PATENT DOCUMENTS 152,635 A * 6/1874 Hewitt ..... 254/391
213,165 A * 3/1879 Brice
473,093 A * 4/1892 Sockman ..... 254/391
538,584 A * 4/1895 Hartz ..... 254/391
558,048 A * 4/1896 Dubois
593,256 A * 11/1897 Velie
729,968 A * 6/1903 Smith
739,986 A * 9/1903 Chevenier
1,122,126 A * 12/1914 Jurgens ..... 254/391
1,304,353 A * 5/1919 Moss ..... 114/365
2,705,354 A * 4/1955 Parsons
5,799,753 A * 9/1998 Peltier ..... 182/234
5,850,893 A * 12/1998 Hede ..... 182/193
5,921,353 A * 7/1999 Day ..... 188/65.4
6,234,454 B1 * 5/2001 Vassioukevitch ..... 254/391

* cited by examiner

*Primary Examiner*—Christopher P. Schwartz
(74) *Attorney, Agent, or Firm*—William D. Durkee; Howrey Simon Arnold & White, LLP

(57) ABSTRACT

An adjustable lifting sling including a stationary support with hanger means, one or more cam surfaces pivotally mounted to the support, a ratable locking arm having one or more corresponding complementary shaped surfaces to allow a tensile lifting member to be controllably locked between the cam and complementary shaped surfaces.

21 Claims, 9 Drawing Sheets

ADJUSTABLE LIFTING SLING

BACKGROUND OF THE INVENTION

1. Field of the Invention

The present invention relates generally to lifting devices and, more particularly, to lifting devices having a locking mechanism.

2. Background of the Invention

Lifting devices are commonly used for lifting and moving products in plants, warehouses, distribution centers, and other locations in the marketplace. Given their widespread and increasing use, it is important that such devices be reliable in operation, easily operated and safe. The lifting devices disclosed herein are improvements of the lifting devices disclosed in U.S. Pat. No. 5,921,353, which issued Jul. 13, 1999, to Steven T. Day.

SUMMARY OF THE INVENTION

In accordance with one aspect of the present invention, an adjustable lifting sling includes a support with means for hanging the support, a locking arm rotatably connected to the support with at least one locking surface and at least one cam surface pivotally connected to the support to mate with the a locking surface and hold a flexible rope, wire, chain, straps, or other tensile lifting member between them. The lifting sling is easy to operate, reliable, and safe. The sling of the invention also allows for adjustment to accept different thicknesses and sizes of the tensile lifting member.

BRIEF DESCRIPTION OF THE DRAWINGS

The present invention will become more fully understood from the following detailed description of the preferred embodiments, taken in conjunction with the accompanying drawings in which.

DESCRIPTION OF ILLUSTRATIVE EMBODIMENTS

Figure 1B:
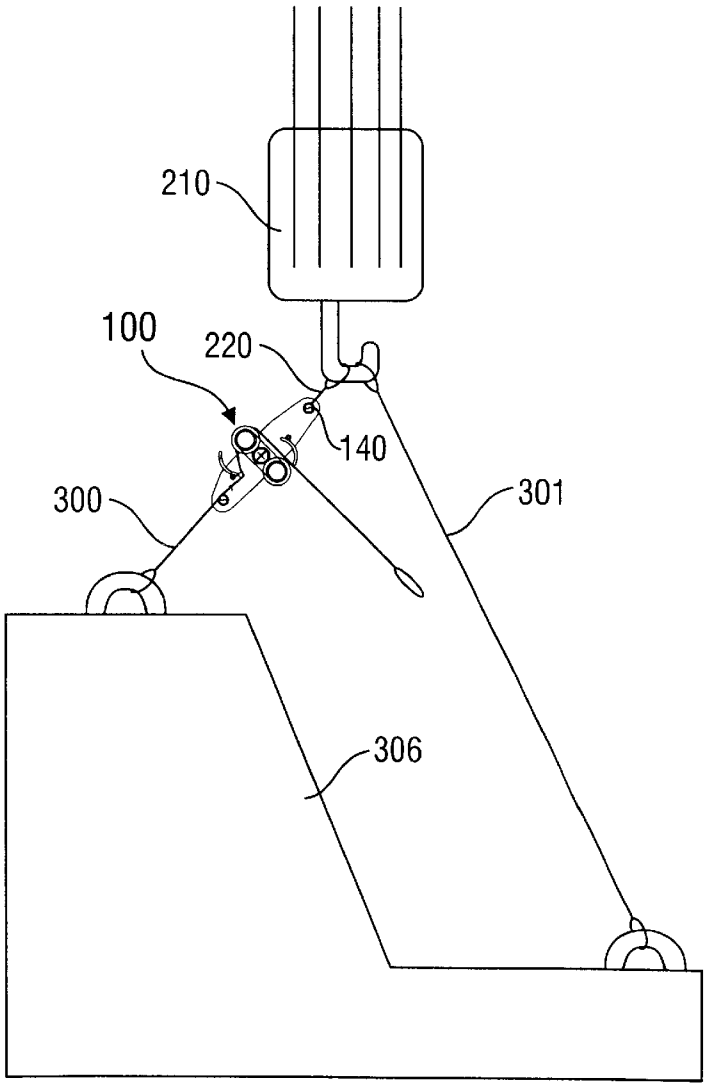
FIG. 1B is a front view of the use of the preferred embodiment of the lifting sling of FIG. 1A in an unlocked position.

The illustrative embodiments described herein provide a lifting sling for lifting and/or holding objects in a stationary position. While illustrated by means of specific illustrative embodiments providing adjustable lifting devices, the present invention will also find broad application to a wide-range of applications calling for locking or fixing the relative or absolute position of two or more objects using a flexible tensile member such as a rope, cable, chain or other similar lifting device.

Referring initially to FIGS. 1A, 1B, 1C, 2A, 2B, 3A, and 3B, an illustrative embodiment of a lifting sling 100 will be described. The lifting sling 100 includes a stationary support or base 110 and a rotatable locking arm 120 mounted on the support 110.

The stationary support 110 includes a support plate 250, a lifting or hanging support means 140 to suspend the sling, a first cam 234, a rotatable locking arm support 160, a second cam 235, and a support guide member 180. The support plate 130 includes a top end 190 and a bottom end 200. The support plate 130 may provide a stationary support structure for all of the remaining elements of the lifting sling 100. The support plate 130 may be fabricated from any number of materials having adequate tensile strength for the anticipated operational environment of the lifting sling 100 and may include materials such as, for example, metal, plastic, rubber, wood, composite, ceramic, or other similar materials. In a preferred embodiment, the support plate 130 is fabricated from steel or aluminum alloys.

As illustrated in FIGS. 1A, 1B, 1C, 2A, and 2B, the lifting or hanging support 140 permits the lifting sling 100 to be attached to a fixed or movable structure 210 by means of a conventional tensile support member 220 such as a rope, cable, chain, metal rod, or other similar device. The lifting or hanging support 140 may comprise any number of conventional physical structures capable of providing a physical connection between the first end 190 of the support plate 130 and the fixed or movable structure 210 using the conventional tensile support member 220. In a one embodiment, the lifting support hanger 140 comprises a rigid post mounted perpendicular to the plane of the support plate 130 on the first end 190 of the support plate 130. The support or hanger 140 may be attached to the support plate 130 using any number of conventional attachment methods such as, for example, mechanical fasteners, welding, brazing, or adhesive bonding. In a preferred embodiment, the support hanger 140 is attached to the first end 190 of the support plate by welding or using a removable pin 139. Alternatively, the support hanger 140 may be manufactured as an integral part of the support plate 130.

Figure 1A:
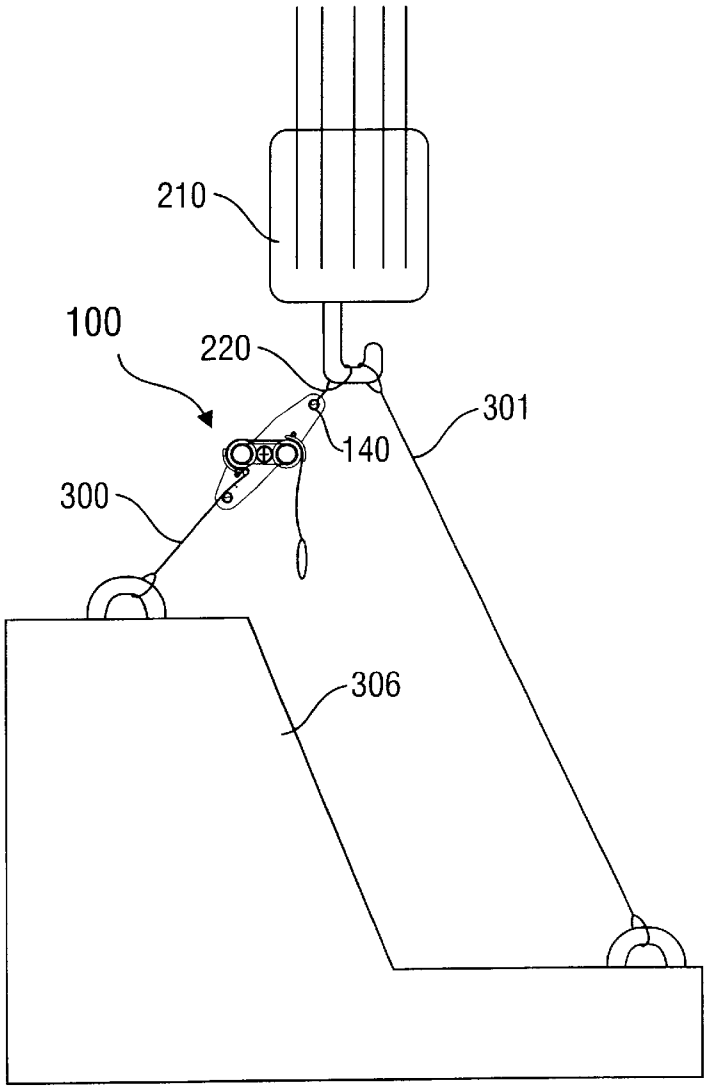
FIG. 1A is a front view of the use of a preferred embodiment of a lifting sling in a locked position.

The oppositely disposed, curved cam members 234 and 235 are attached to the support plate 130 and are preferably oriented substantially perpendicular to the plane of the support plate 130. The lower cam 235 is mounted to the base plate 130 preferably in a rotatable manner such as by pin 241 attached to base plate 130 and by sleeve 242 rotatably mounted on pin 241. Pin 241 could also be rotatably mounted to base plate 130. Sleeve 242 may be welded to cam 235 or otherwise affixed, and cam 235 preferably includes a stiffening strip 236 welded, cast, or otherwise affixed along its back side and a hole 237 in the strip 236 to help unlock the cam 235 from the locking surface 333. The upper cam 234 is mounted to the base plate 130 by pin 244 attached to the base plate 130 and by sleeve 248 affixed or welded to cam 234 and rotatably mounted on pin 244. Pin 244 could also be rotatably mounted to base plate 130. The upper and lower cam structures 234 and 235 provide a locking mechanism by the interaction of their first and second cam surfaces 270 and 280 respectively, with corresponding mating surfaces 333 and 334 on the rotating member 120 as illustrated in FIGS. 1A, 1B, and 2A. Weld 230 may be used to attach the sleeve 248 to the curved cam structure 234. Weld 240 may be used to attach the sleeve 242 to the curved cam structure 235. Stop 351 may be attached to base plate 130 to keep the cam member from rotating too far downwardly when the sling is in an unlocked position. Stop 351 may be a raised weld on the plate 130, may be the head of a bolt screwed into the base plate 130, or other suitable stop structure affixed to the base plate 130.

The first and second cams 234 and 235 are preferably positioned substantially equidistant from the pivoting axis 290 for the rotatable locking arm 120. The cross-sectional shapes of the first and second cam surfaces 270 and 280 may comprise any number of arcuate shapes such as elliptical, circular, hyperbolic, polygonal, or other similar shaped surfaces. In a preferred embodiment, the cross-sectional shapes of the first and second cam surfaces 270 and 280 are circular segments. In the preferred embodiment, the radii of the first and second cam surfaces 270 and 280 may range from approximately 0.17 to 0.50 feet, and preferably the radii of the first and second cam surfaces 270 and 280 range from approximately 0.19 to 0.21 feet. The central angle of the first and second cam surfaces 270 and 280 may range from approximately 35 to 45 degrees, and in a preferred embodiment the central angle of the first and second cam surfaces 270 and 280 range from about 40 to 45 degrees. The radii and central angles of the first and second cam surfaces 270 and 280 are preferably substantially the same. The first and second cam members 234 and 235 should be oriented and sized to permit the rotating member 120 to interact with the first and second cam surfaces 270 and 280 and thereby lock together as shown in FIG. 2A.

The lifting sling and its elements may be fabricated from any number of conventional structural materials such as, for example, metal, plastic, ceramic, composite, rubber, wooden or other similar materials. In a preferred embodiment, the cam members 234 and 235 are fabricated from steel. The cam pins 241 and 246 may be attached to the support plate 130 using any number of conventional fastenings methods such as, for example, mechanical fasteners, welding, brazing, adhesive bonding, or other similar joining methods, and may fit rotatably in holes in the support plate 130.

The rotatable support 160 provides support for the rotatable locking arm 120 and thereby permits the rotatable arm 120 to rotate about the rotating axis 290. The rotatable support 160 may comprise any number of conventional rotational supports such as, for example, a ball bearing, thrust bearing, journal bearing, or other similar bearing devices. The rotatable support 160 may be mounted onto the support plate 130, via an opening in the support plate 130, using any number of conventional attachment methods such as, for example, mechanical fasteners, welding, brazing, interference fit, adhesive bonds, or other similar methods. In a preferred embodiment, the rotatable support 160 comprises a bushing and shaft and is mounted onto the support plate 130 by interference fit. Alternatively, the rotatable support 160 may be manufactured as an integral part of the support plate 130.

The support guide member 180 guides the tensile member 300 which is locked in position within the lifting sling 100 by the interaction of the rotatable locking arm 120 and the cams 234 and 235. The support guide member 180 may comprise any number of conventional devices used for guiding tensile members such as, for example, pulleys, shafts, removable pins, or other similar devices. The support guide 180 may be mounted onto the support plate 130, via an opening in the support plate 130, using any number of conventional attachment methods such as, for example, mechanical fasteners, welding, brazing, interference fit, adhesive bonds, or other similar methods. In a preferred embodiment, the support guide 180 comprises a removable pin and is mounted onto the support plate 130 by conventional mechanical fasteners. Alternatively, the support guide member 180 may be manufactured as an integral part of the support plate 130. The guiding surface 181 on the guide 180 lies preferably near a longitudinal axis along the support 110 which passes through the center of the hanger 140 and the rotational axis 290.

The lower cam 235 comprises a guide surface 252 located inwardly near the rotation pin 241 for lower cam 235. This lower cam guide 252 is located to guide the lifting tensile member 300 into the cam space between the cam 235 and the cam locking member 330, and is positioned for the load on tensile member 300 to force the major position of the cam surface 270 to bear against the tensile member 300 and the locking surface 333 to hold the tensile member 300 without slippage. The cam 235 is constructed so that the lower cam guide 252 has a short lever arm compared to the remaining bearing surface 270. The load on tensile member 300 forces the guide 252 down which in turn pivots the longer surface of cam surface 232 against the locking surface 333.

A longitudinal center line 141 passes through center of top lifting support 140 and the axis 290 of the rotary member 120. The center of rotation for upper cam 234 about pin 246 is on one side of the vertical center line 141 and the center of rotation for lower cam 235 about pin 241 is on the other side of the vertical center line 141. The guide 180 for the tensile member preferably has its guiding side approximately on the center line to allow the lifting sling to remain straight from the hanger 140. The lower cam guide 252 has its guiding surface located with respect to the center line to cause the tensile member to bend around the guiding surface before entry between the cam 235 and the locking surface 330. The guiding surface of guide 252 is preferably substantially round in shape and is preferably located in part slightly to the other side of the center line from the side where the lower cam 235 is mounted rotatably. The guide 252 preferably has the center of its substantially round guiding surface approximately on the longitudinal axis 141.

Figure 3A:
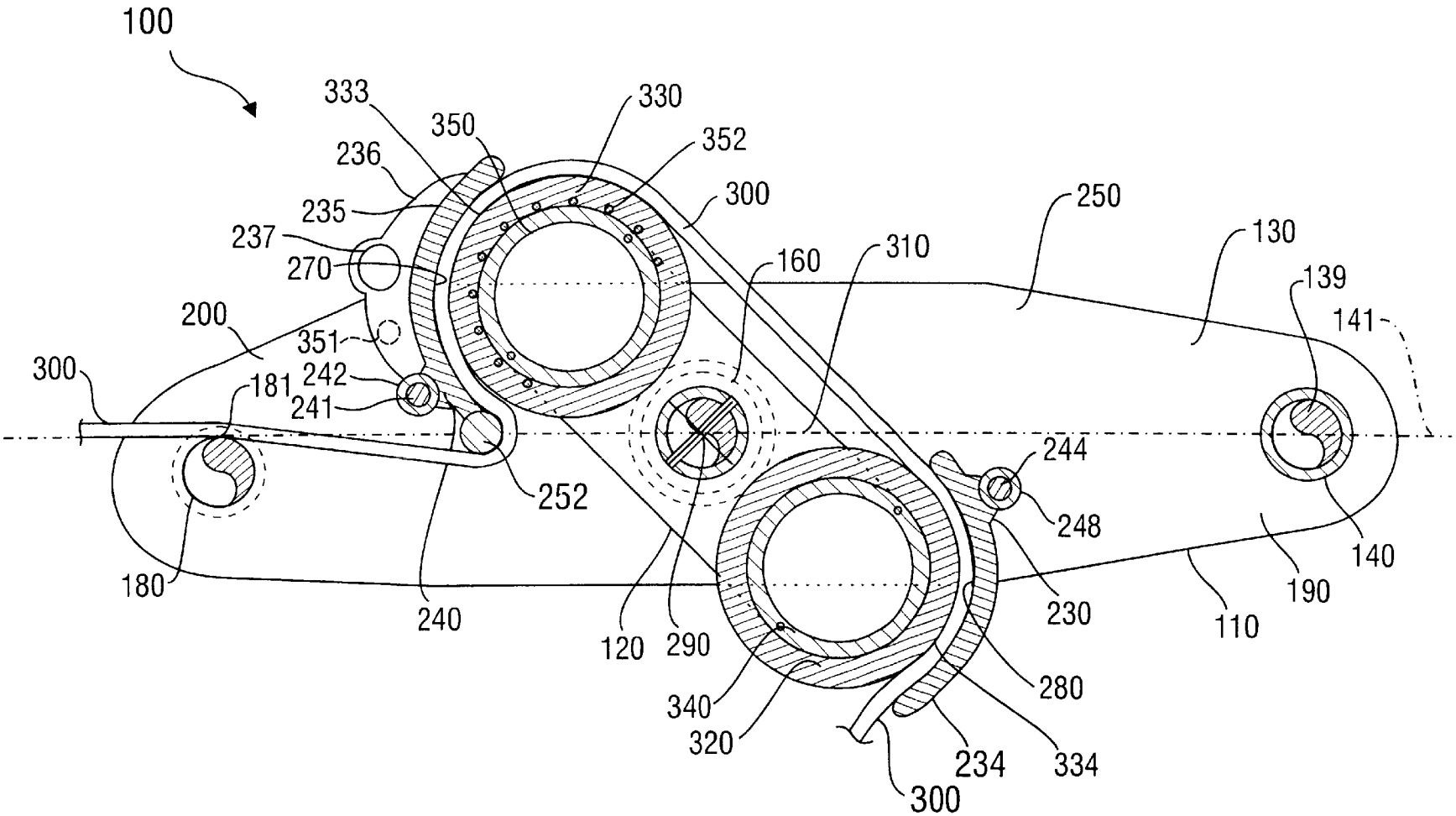
FIG. 3A is a sectional view of an embodiment of the lifting sling of FIGS. 1A, 1B, 1C, 2A and 2B in a locked position.
Figure 3B:
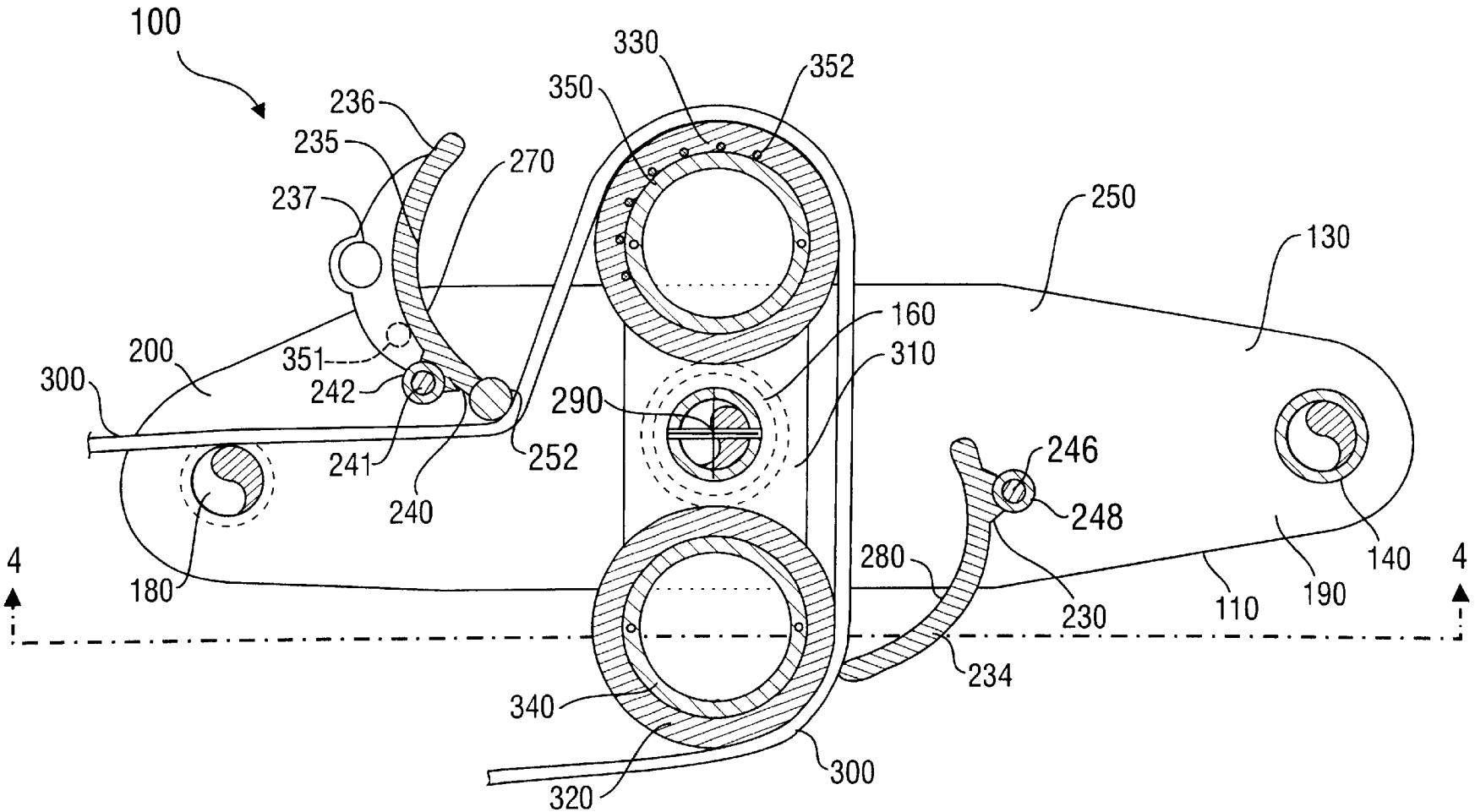
FIG. 3B is a sectional view of the embodiment shown in FIG. 3A with the sling in an unlocked position, this view being taken along line 3B—3B in FIG. 4.

With reference to FIG. 3A, the rotating member 120 includes a rotary locking arm 310, a first cam locking member 320, and a second cam locking member 330. Counter-clockwise rotation of the rotating member 120 about the rotational axis 290 causes the first and second cam locking members 320 and 330 to lock the flexible tensile member 300 against the lower and upper cam surfaces 270 and 280 of the cam members 234 and 235. Conversely, with reference to FIG. 3B, clockwise rotation of the rotating member 120 about the rotation axis 290 releases the tensile member 300 and permits adjustment of the length of the tensile member 300 which extends from the lifting sling 100. In this manner, the lifting sling 100 permits the relative position between two or more objects to be adjusted and then fixed. In a preferred embodiment, the lifting sling 100 includes a pair of cam members 234 and 235 and a pair of locking members 320 and 330. Alternatively, the lifting sling 100 may utilize a single cam member and a single locking member. Furthermore, the cross-sectional shapes of the cam surfaces of the cam members and the corresponding mating surfaces of the locking members may comprise any number of shapes such as, for example, arcuate, elliptical, parabolic, polygonal, or other similar complementary shapes. In a preferred embodiment, the upper and lower cam surfaces 270 and 280 and the corresponding locking members 320 and 330 have cross-sectional shapes which comprise complementary shaped circular segments. These complementary surfaces may also contain concave surfaces to accept and direct the tensile member between the cam and locking surfaces. One or more of the complementary surfaces may be made of rubber or rubber-like material to help grasp the tensile member between the complementary surfaces.

Figure 2B:
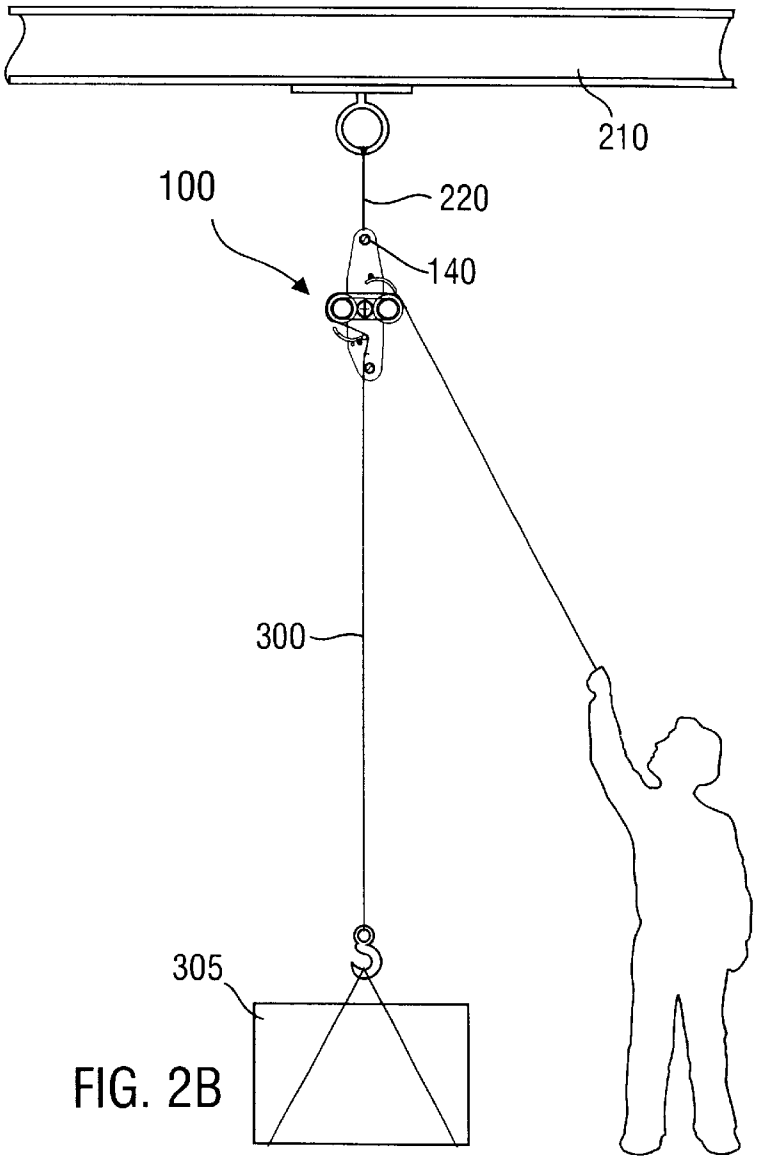
FIG. 2B is a front view of the still another use of the preferred embodiment of the lifting sling of FIG. 2A in an unlocked position.
Figure 2A:
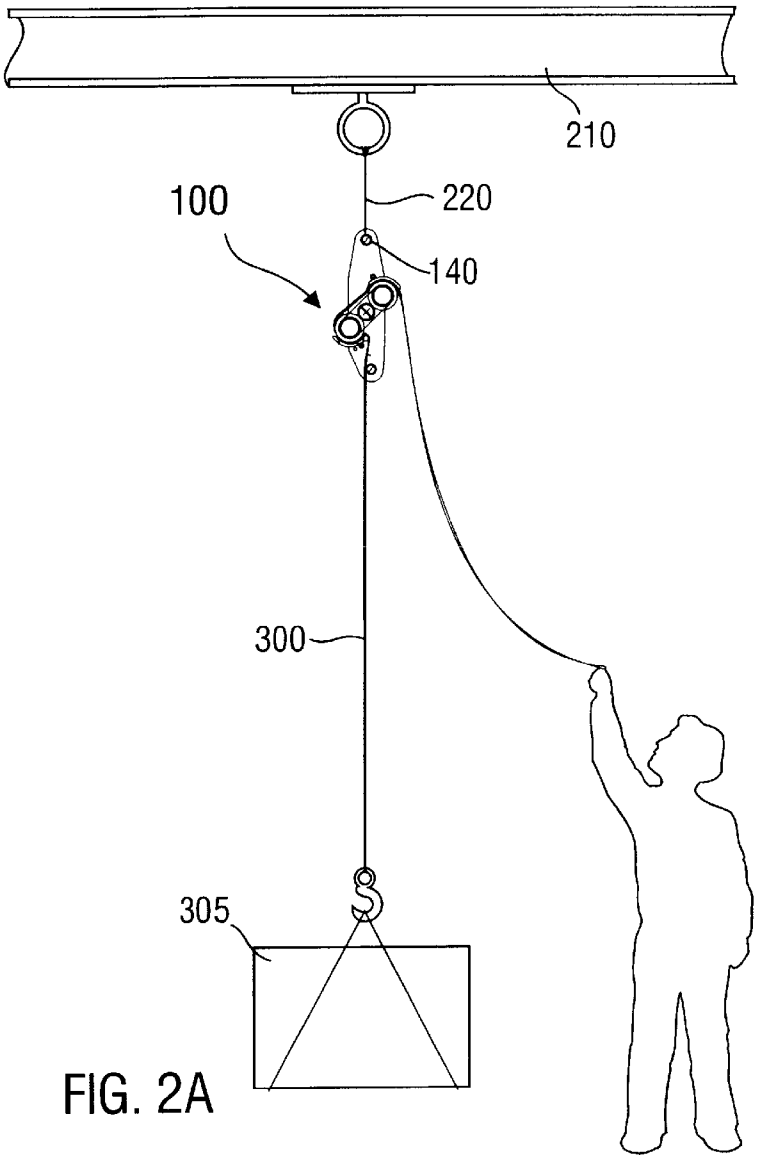
FIG. 2A is a front view of still another use of a preferred embodiment of a lifting sling in a locked position.

In one embodiment, the first and second locking members 320 and 330 are substantially round in cross section and the upper and lower cam surfaces 270 and 280 are substantially circular segments in cross-section to facilitate the movement of the tensile member 300 within the lifting sling 100 while the lifting sling 100 is in the unlocked position as illustrated in FIGS. 1B and 2B.

The rotary support member 310 provides support for the first and second locking members 320 and 330. The rotary support member 310 is supported by the rotary support 160 in a conventional manner and rotates about the rotation axis 290. The rotary support member 310 may be fabricated from any number of rigid materials such as, for example, metal, plastic, wood, composite, ceramic, or other similar materials.

The first and second locking members 320 and 330 extend from and are supported by the rotary support member 310. In a preferred embodiment, the first and second locking members 320 and 330 extend from and are substantially perpendicular to the plane of the rotary support member 310. In a particularly preferred embodiment, the first and second locking members 320 and 330 are supported on the rotary support member 310 by first and second locking member supports 340 and 350 which extend from and are substantially perpendicular to the plane of the rotary support member 310. The cross-sectional shapes of the first and second locking members 320 and 330 are selected to be approximately complementary to the cross-sectional shapes of the first and second cam surfaces 270 and 280. The first and second locking members 320 and 330 may be fabricated from any number of materials such as, for example, metal, plastic, wood, rubber, ceramic, composite or other similar materials. In a particularly preferred embodiment, the first and second locking members 320 and 330 are fabricated from vulcanized rubber. Transverse rods 352 may be spaced around the outside surface of the support 350 to keep the locking member 330 from slipping around the support 350, particularly when the locking member 330 is made of rubber. These transverse rods, which may be cold rolled rods about ¼" in diameter, may be spaced all the way around the periphery of the support 350 or only on its surface which bears against the cam member 235. Transverse anti-slippage rods may also be installed on locking member support 340 if desired to prevent slippage of locking member 320 around support 340. The transverse rods may be attached to the supports 340 and 350 by welding or other suitable means. Supports 340 and 350 could also include peripheral teeth like gear teeth to prevent slippage.

Figure 1C:
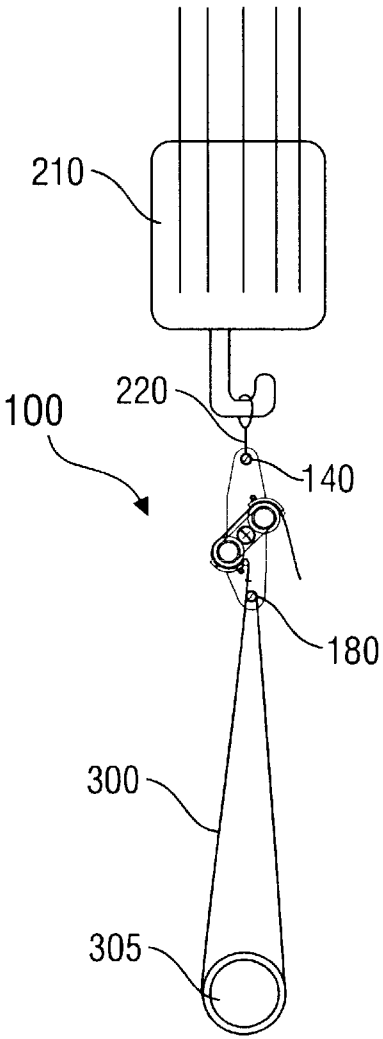
FIG. 1C is a front view of another use of the preferred embodiment of the lifting sling in a locked position.

As illustrated in FIGS. 1A, 1B, 1C, 2A and 2B, in a preferred embodiment, the lifting sling 100 is used in combination with a fixed or movable structure 210, tensile support member 220, and tensile member 300 to adjustably position an object 305 by selectively locking and unlocking the lifting sling 100. In a particularly preferred embodiment, as illustrated in FIGS. 1A and 1B, an additional fixed tensile member 301 is further utilized to permit objects 306 having a non-uniform weight distribution to be easily and safely held in a desired fixed spatial orientation relative to a fixed or movable structure 210. In an alternative embodiment, as illustrated in FIG. 1C, the tensile member 300 is looped about the object 305 and then affixed to an end of the support member 180 using conventional mechanical fasteners.

Figure 4:
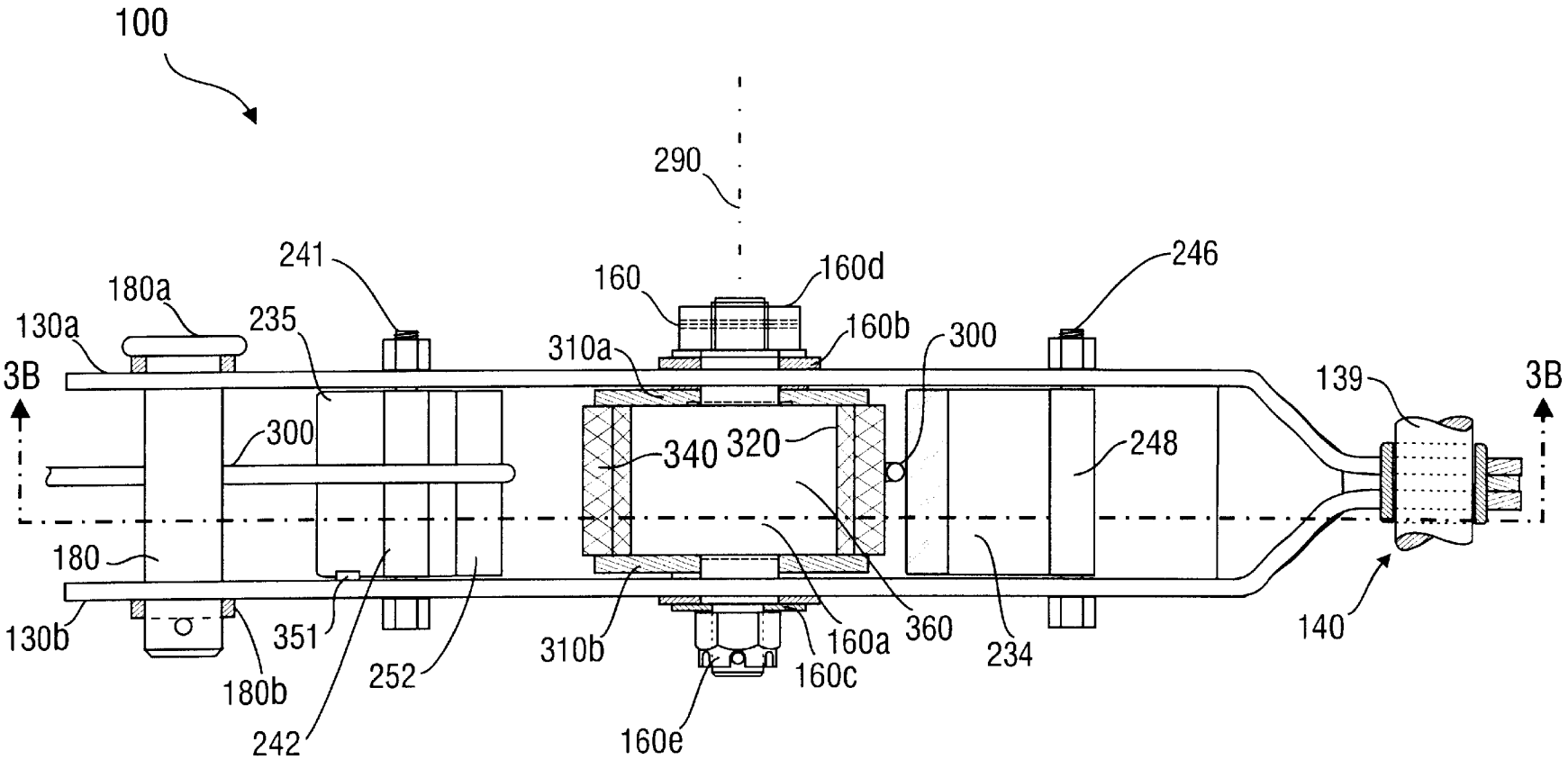
FIG. 4 is a sectional view of the embodiment of the lifting sling of FIG. 3B taken along the line 4—4.
Figure 5B:
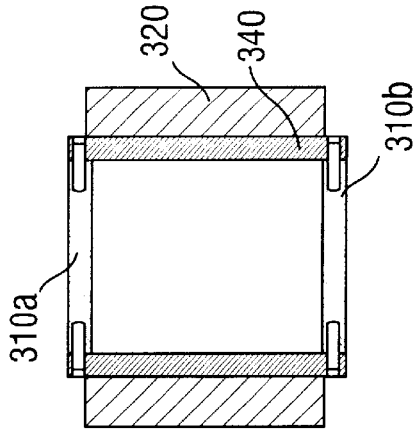
FIG. 5B is a sectional view of the rotating member of FIG. 5A taken along the line 5B—5B.
Figure 5D:
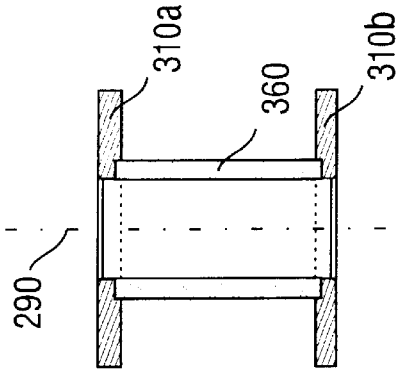
FIG. 5D is a sectional view of the rotating member of FIG. 5A taken along the line 5D—5D.
Figure 5A:
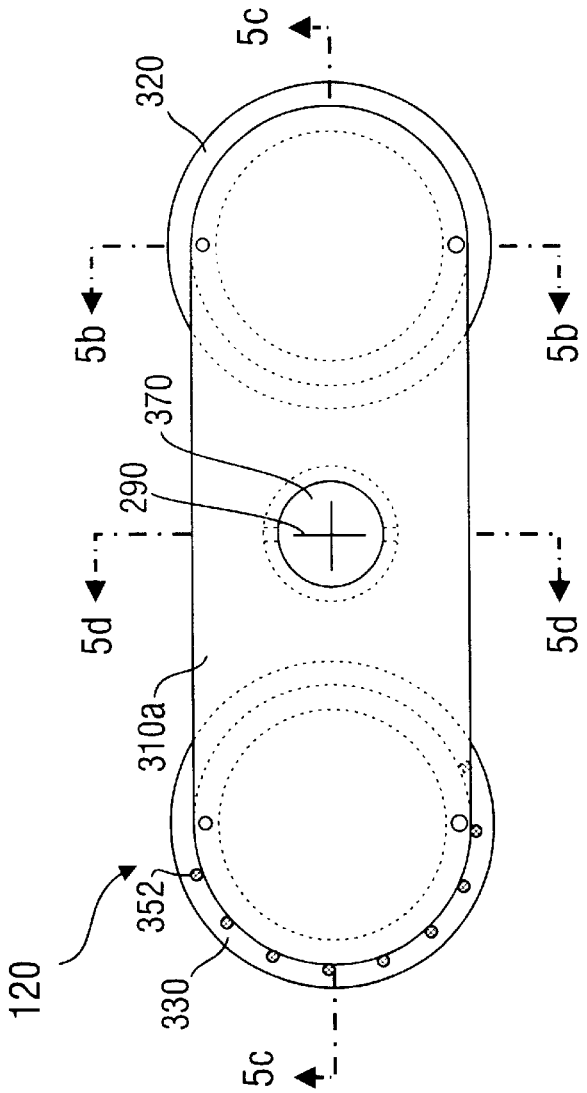
FIG. 5A is a front view of the rotating member of the embodiment of the lifting sling of FIG. 4.
Figure 5C:
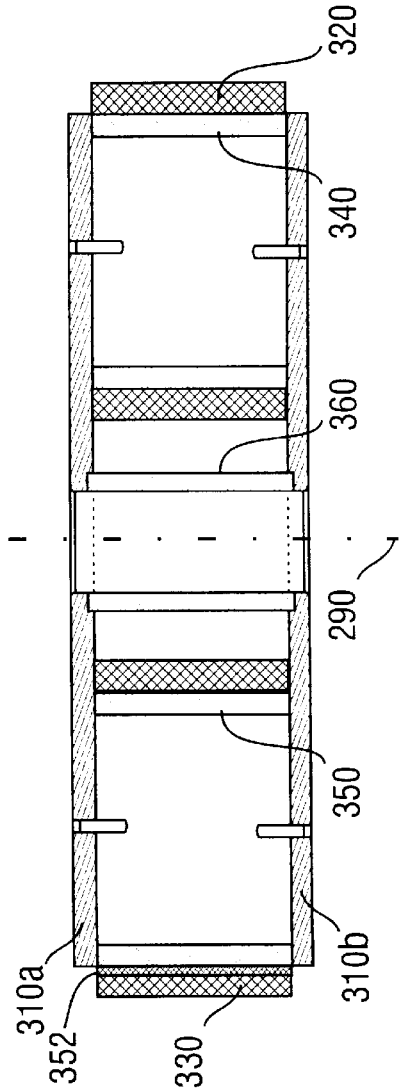
FIG. 5C is a sectional view of the rotating member of FIG. 5A taken along the line 5C—5C.

Referring now to FIGS. 4, 5A, 5B, 5C, and 5D, a preferred embodiment of the lifting sling 100 will be described. As illustrated in FIG. 4, the stationary base support 110 further includes an upper support plate 130*a*, lower support plate 130*b*, a retaining pin 180*a*, a retaining ring 180*b*, a support shaft 160*a*, upper washers 160*b*, lower washers 160*c*, upper retaining nut or cam 160*d*, and lower retaining nut 160*e*.

The upper support plate 130*a* and the lower support plate 130*b* are spaced to sandwich the upper and lower cam members 234 and 235, and the rotating member 120 thereby providing a more rigid and durable structure. The retaining pin 180*a* and retaining ring 180*b* provide support and provide guide 180 for the tensile member 300. The support shaft 160*a*, upper washers 160*b*, lower washers 160*c*, upper retaining nut or cam 160*d*, and lower retaining nut 160*e* support the rotary member 120.

As illustrated in FIGS. 5A, 5B, 5C, and 5D the rotary member 120 further includes an upper rotary support member 310*a*, a lower rotary support member 310*b*, a central bearing member 360, and a central passage 370.

The upper rotary support member 310*a* and the lower rotary support member 310*b*, together sandwich the first and second locking members 320 and 330 thereby providing a rigid and durable structure. The central bearing member 360 together with the upper and lower rotary support members 310*a* and 310*b* defines the central passage 370. The central passage 370 is substantially centered about the rotation axis 290 and slidably fits around the support shaft 160*a* to permit rotation of the rotating member 120 relative to the stationary support 110.

Figure 6A:
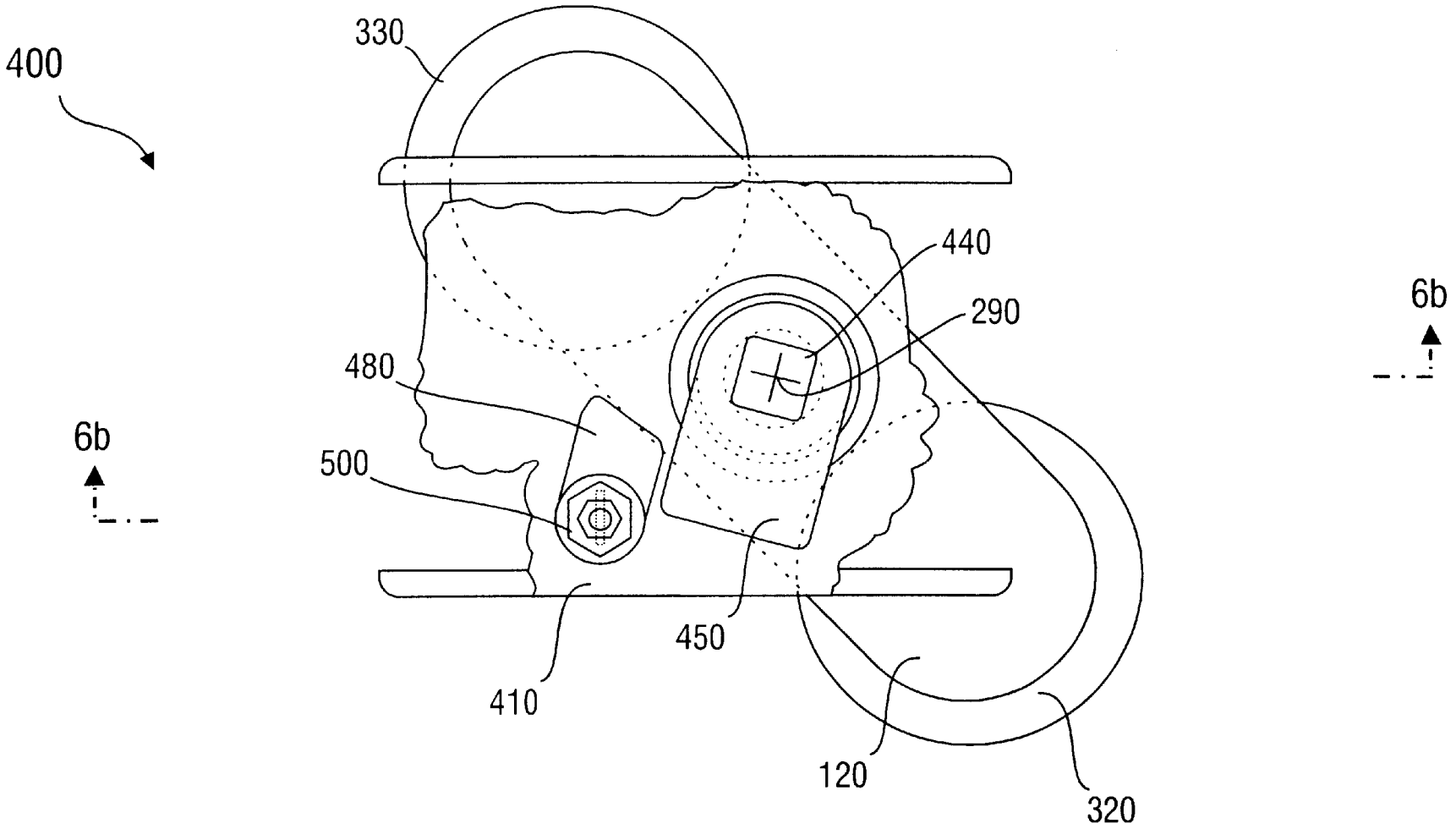
FIG. 6A is a fragmentary front view of the cam locking mechanism of an embodiment of the lifting sling in the unlocked position.
Figure 6B:
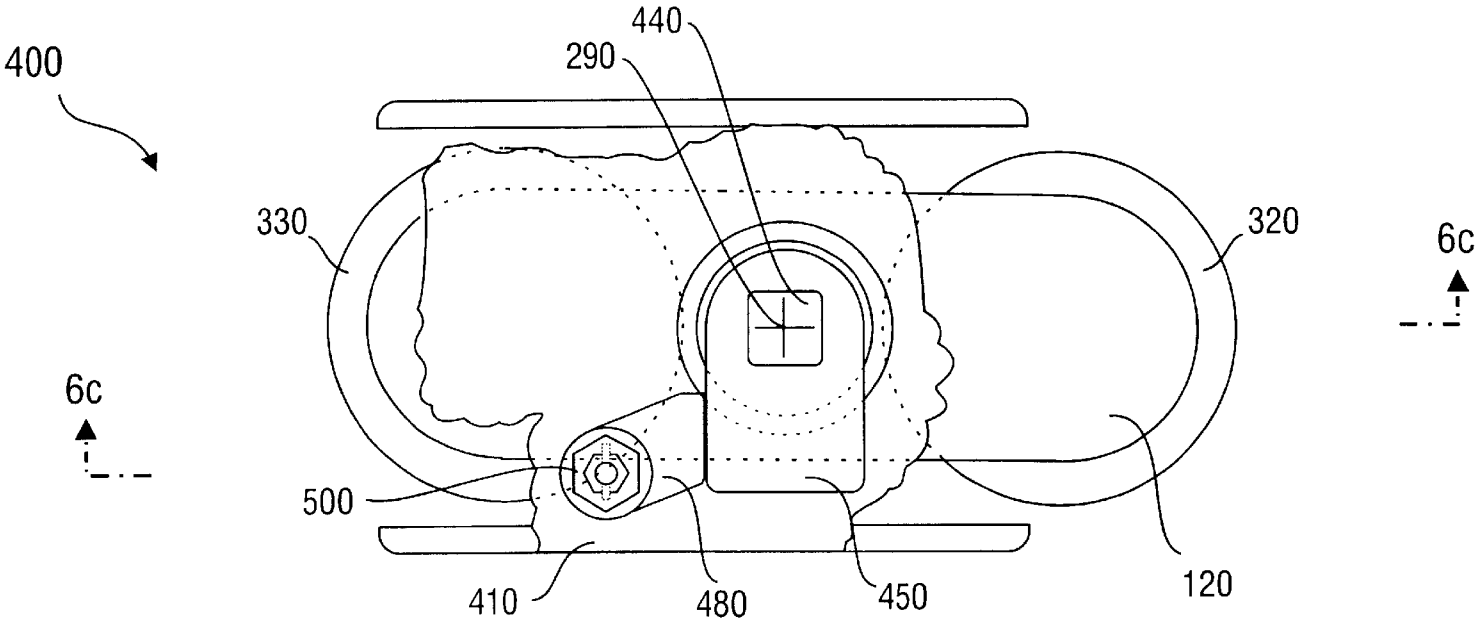
FIG. 6B is a fragmentary front view of the cam locking mechanism of an embodiment of the lifting sling in the locked position.
Figure 6C:
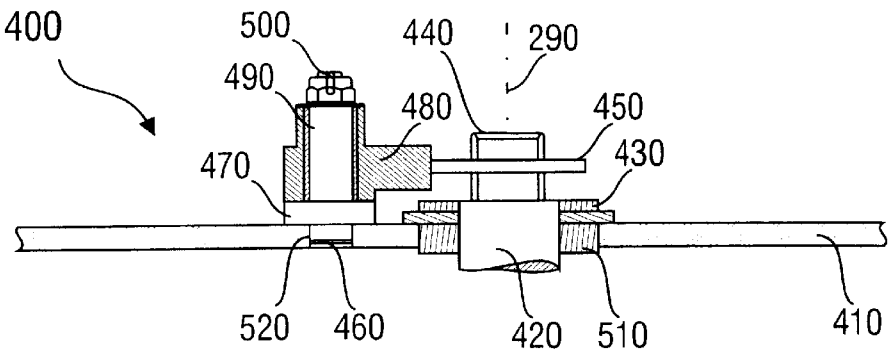
FIG. 6C is a sectional view of the locking mechanism of FIG. 6B taken along the line 6C—6C.

Referring to FIGS. 6A, 6B, and 6C, a preferred embodiment of a locking mechanism 400 for the lifting sling 100 will now be described. The preferred embodiment of the locking mechanism 400 for the lifting sling 100 includes a mounting plate 410, a drive shaft 420, drive shaft mounting hardware 430, drive cam mounting shaft 440, drive cam 450, control shaft 460, control shaft mounting hardware 470, control cam 480, control cam mounting shaft 490, and control cam retaining hardware 500.

The mounting plate 410 provides support for the remaining portions of the locking mechanism 400. The locking plate may be fabricated from any number of conventional materials such as, for example, metal, plastic, rubber, wood, ceramic, composite or similar materials. In a preferred embodiment, the mounting plate 410 is fabricated from steel. The mounting plate 410 further includes a drive shaft passage 510 and a control shaft passage 520 which permit passage of the drive shaft 420 and control shaft 460 respectively. The mounting plate 410 is attached to the stationary member 110 using conventional methods and may be a separate plate or integral to the support plates 130, 130*a*, or 130*b*.

The drive shaft 420 is connected to the rotary member 120 using conventional methods and thereby permits the locking mechanism 400 to control the rotary position of the rotary member 120. The drive shaft 420 is rotatably mounted onto the mounting plate 410 using drive shaft mounting hardware 430. The drive shaft mounting hardware 430 may comprise any number of conventional rotary shaft mounting hardware. In a preferred embodiment, the drive shaft mounting hardware comprises bushings, bearings and nuts. One end of the drive shaft 420 includes the drive cam mounting shaft 440 which permits the drive cam 450 to be removably mounted onto the drive shaft 420. In this manner, the drive cam 450 is able to impart rotary motion to the rotary member 120. The drive cam 450 may be connected to the drive cam mounting shaft 440 using any number of conventional methods such as, for example, splines, drive pins, snap rings, or washers and nuts. In a preferred embodiment, the drive cam 450 is attached to the drive cam mounting shaft 440 by a drive pins.

The control shaft 460 is rotatably mounted onto the mounting plate 410 within the control shaft passage 520 using the control shaft mounting hardware 470. The control shaft mounting hardware 470 may comprise any number of conventional rotary shaft mounting hardware such as, for example, washers or weldments. In a preferred embodiment, the control shaft mounting hardware comprises an integral hub on control shaft 460 that is welded to the mounting plate 410. One end of the control shaft 460 includes the control cam mounting shaft 490 which removably carries the control cam 480. In this manner, rotation of the control cam 480 can be achieved about the control cam mounting shaft 490. The control cam 480 may be removably mounted onto the control cam mounting shaft 490 using any number of conventional mounting hardware such as, for example, bushings, slip fit, or bearings. In a preferred embodiment, the control cam 480 is removably mounted onto the control cam mounting shaft 490 using bushings. The control cam 480 is further retained upon the control cam mounting shaft 490 by control cam retaining hardware 500. The control cam retaining hardware 500 may comprise any number of conventional mechanical fasteners. In a preferred embodiment, the control cam retaining hardware 500 comprises washers and nuts.

As illustrated in FIGS. 6A, 6B, and 6C, the rotary member 120 may be locked in position by clockwise rotation of the control cam 480. The clockwise rotation of the control cam 480 may be effected using any number of conventional actuation mechanisms such as, for example, an open end wrench, crescent wrench, or socket wrench. In a preferred embodiment, the control cam 480 is rotated into and out of the locked position by a crescent wrench.

A lifting sling has been described having enhanced operating characteristics for maintaining the relative position of a plurality of objects with enhanced safety. The lifting sling is especially well suited for application in lifting and maintaining stationary large and heavy objects. The teachings of the present illustrative embodiments will find wide application to the general area of positioning systems and their illustration by means of a specific embodiment is not meant to limit their application.

What is claimed is:

1. An adjustable lifting sling which comprises:

a) a support having means to hang the support;

b) a locking arm rotatably connected to the support about a locking arm axis, the locking arm having oppositely disposed locking surfaces;

c) an upper cam having a pivotal connection to the support about an upper cam axis spaced from the locking arm axis and having a cam surface which mates with a locking surface of the locking arm;

d) a lower cam having a pivotal connection to the support about a lower cam axis spaced from the locking arm axis and having a cam surface which mates with a locking surface of the locking arm;

e) the sling being able to hold a lifting member between the cam surface of the lower cam and the mating locking surface of the locking arm and the cam surface of the upper cam and the mating locking surface of the locking arm.

2. The sling of claim 1 in which a cam guide is associated with the entrance of the lower cam to direct the lifting member between the cam surface of the lower cam and the mating locking surface of the locking arm.

3. The sling of claim 2 in which the support comprises a lower guide to direct the lifting member to the cam guide.

4. The sling of claim 3 in which the cam guide has a surface for the lifting member on a location near the pivotal connection of the lower cam.

5. The sling of claim 1 in which the support has a longitudinal axis through the means for hanging the support, the pivotal connection of the upper cam being on one side of the longitudinal axis and the pivotal connection of the lower cam being on the other side of the longitudinal axis.

6. The sling of claim 5 in which the cam surface of the lower cam faces upwardly to mate with its locking surface and the cam surface of the upper cam faces downwardly to mate with its locking surface.

7. The sling of claim 6 in which the cam surfaces and the locking surfaces are arcuate in shape.

8. The sling of claim 1 in which the center of the means for hanging the support and the center of the locking arm axis form a longitudinal axis with respect to the support.

9. The sling of claim 8 in which the pivotal connection of the upper cam is spaced above the locking arm axis and the pivotal connection of the lower cam is spaced below the locking arm axis.

10. The sling of claim 8 in which the pivotal connection of the upper cam is on one side of the longitudinal axis and the pivotal connection of the lower cam is on the other side of the longitudinal axis.

11. The sling of claim 10 in which a major part of the cam surfaces extends from the pivotal connection away from the longitudinal axis.

12. The lifting sling of claim 1 wherein the pivotal connections of the upper cam and lower cam on said support are spaced equidistant from the locking arm axis.

13. The lifting sling of claim 1 wherein the upper cam surface and the lower cam surface form a substantially circular segment in cross-section.

14. The lifting sling of claim 13 wherein each of the locking surfaces form a substantially circular segment.

15. The lifting sling of claim 1 wherein said support comprises spaced parallel plates with the locking arm, upper cam, and lower cam being supported between and by both of the plates.

16. The lifting sling of claim 1 comprising a drive cam coupled to said locking arm and a control cam coupled to said support to lock the drive cam and the locking arm in a fixed position.

17. The lifting sling of claim 16 wherein said control cam is rotatably supported by said support.

18. The apparatus of claim 17 in which the control cam has a shape for actuation by a wrench.

19. The apparatus of claim 1 in which the lower cam has a guide surface offset from the pivotal connection to allow a tensile member to pull down on the guide surface and rotate the cam surface on the other side of the pivotal connection against the mating locking surface.

20. An adjustable lifting sling which comprises:

a) a support having means to hang the support;

b) a locking arm rotatably connected to the support about a locking arm axis, the locking arm having at least one arcuate locking surface facing downwardly;

c) a cam having a pivotal connection to the support and having an arcuate cam surface facing upwardly to rotate about the pivotal connection and mate with the locking surface;

d) the cam having a guide surface on the other side of the connection whereby downward force on the guide surface rotates the arcuate cam surface upwardly toward the locking surface.

21. The lifting sling of claim 20 in which the guide surface is substantially round in shape and the locking arm axis and the center of the guide surface are located substantially on a vertical axis passing through both.

* * * * *